US007584919B2

(12) United States Patent
Adler et al.

(10) Patent No.: US 7,584,919 B2
(45) Date of Patent: Sep. 8, 2009

(54) COMPACTING DEVICE

(75) Inventors: Peter Adler, Rheinfelden (DE); Andreas Gölz, Maulburg (DE); Holger Kirchner, Friedrichsdorf (DE); Armin Müller, Freiberg (DE); Torsten Sill, Freiberg (DE); Raymund Sonnenschein, Frankfurt (DE)

(73) Assignee: Joint Solar Silicon GmbH & Co. KG, Freiberg (DE)

( * ) Notice: Subject to any disclaimer, the term of this patent is extended or adjusted under 35 U.S.C. 154(b) by 154 days.

(21) Appl. No.: 11/569,783

(22) PCT Filed: May 10, 2005

(86) PCT No.: PCT/EP2005/005019

§ 371 (c)(1),
(2), (4) Date: Nov. 29, 2006

(87) PCT Pub. No.: WO2005/118272

PCT Pub. Date: Dec. 15, 2005

(65) Prior Publication Data

US 2007/0248438 A1 Oct. 25, 2007

(30) Foreign Application Priority Data

Jun. 4, 2004 (DE) ..... 10 2004 027 564

(51) Int. Cl.
*B02C 19/00* (2006.01)

(52) U.S. Cl. ..... 241/235; 241/295

(58) Field of Classification Search ..... 241/30, 241/235, 293, 295
See application file for complete search history.

(56) References Cited

U.S. PATENT DOCUMENTS

| | | | | |
|---|---|---|---|---|
| 3,622,091 | A * | 11/1971 | Bidwell | 241/222 |
| 3,867,490 | A | 2/1975 | Gorling et al. | |
| 4,807,819 | A | 2/1989 | Kreher et al. | |
| 4,941,251 | A | 7/1990 | Sobue et al. | |
| 5,257,965 | A * | 11/1993 | Fuchs et al. | 492/6 |
| 5,707,326 | A * | 1/1998 | Hyllberg | 492/53 |

FOREIGN PATENT DOCUMENTS

| | | | |
|---|---|---|---|
| CN | 2 231 144 | Y | 7/1996 |
| DE | 539 923 | | 12/1931 |
| DE | 43 44 206 | | 6/1995 |
| EP | 1 074 362 | | 2/2001 |
| JP | 57 067019 | | 4/1982 |
| JP | 58 145611 | | 8/1983 |
| JP | 6-48709 | * | 2/1994 |

* cited by examiner

*Primary Examiner*—Mark Rosenbaum
(74) *Attorney, Agent, or Firm*—McGlew and Tuttle, P.C.

(57) ABSTRACT

Compacting device for the low-metal compaction of a powder with a casing which at least in part surrounds a working chamber, with a feed arrangement arranged on the casing and feeding a powder, which is to be compacted, into the working chamber, with at least a compacting roller which is rotatably arranged in the working chamber, comprises a roller jacket and, together with an opposing wall, forms a compacting gap for compacting the powder therein, characterised in that the at least one compacting roller consists of ceramic, at least on the roller jacket.

15 Claims, 2 Drawing Sheets

COMPACTING DEVICE

BACKGROUND OF THE INVENTION

Field of the Invention

For a long time, the low-metal or metal-free compaction of powders has been an technical challenge. Roller compaction is a known method for compacting powders. With this method, powder is compacted between two rollers which rotate in opposite directions. The specific contact pressures occurring are from 5N/cm to 50 kN/cm. Metal rollers are generally used for this application. The high specific contact forces, which can be as high as the yield point of the metal roller in certain regions, cause wear to the rollers. The abraded material passes into the product. This abraded metal is undesirable and even harmful for applications in photovoltaics, the semi-conductor industry, pharmaceuticals and the chemical industry, as metallic impurities in the range of ppm or ppb lead to defective products.

SUMMARY OF THE INVENTION

The object of the invention is to provide a compacting device for the low-metal or metal-free compaction of a powder.

The object is achieved by having a casing which at least in part surrounds a working chamber, having a feed arrangement arranged on the casing and feeding a powder, which is to be compacted, into the working chamber, having at least a compacting roller which is rotatably arranged in the working chamber, comprises a roller jacket and, together with an opposing wall, forms a compacting gap for compacting the powder therein, wherein the at least one compacting roller consists of a non-metallic material, at least on the roller jacket. The core of the invention is to provide, in a compacting device, compacting rollers which consist of ceramic, at least on their jacket. This prevents the abrasion of metal during compaction.

DESCRIPTION OF THE PREFERRED EMBODIMENTS

Figure 1:
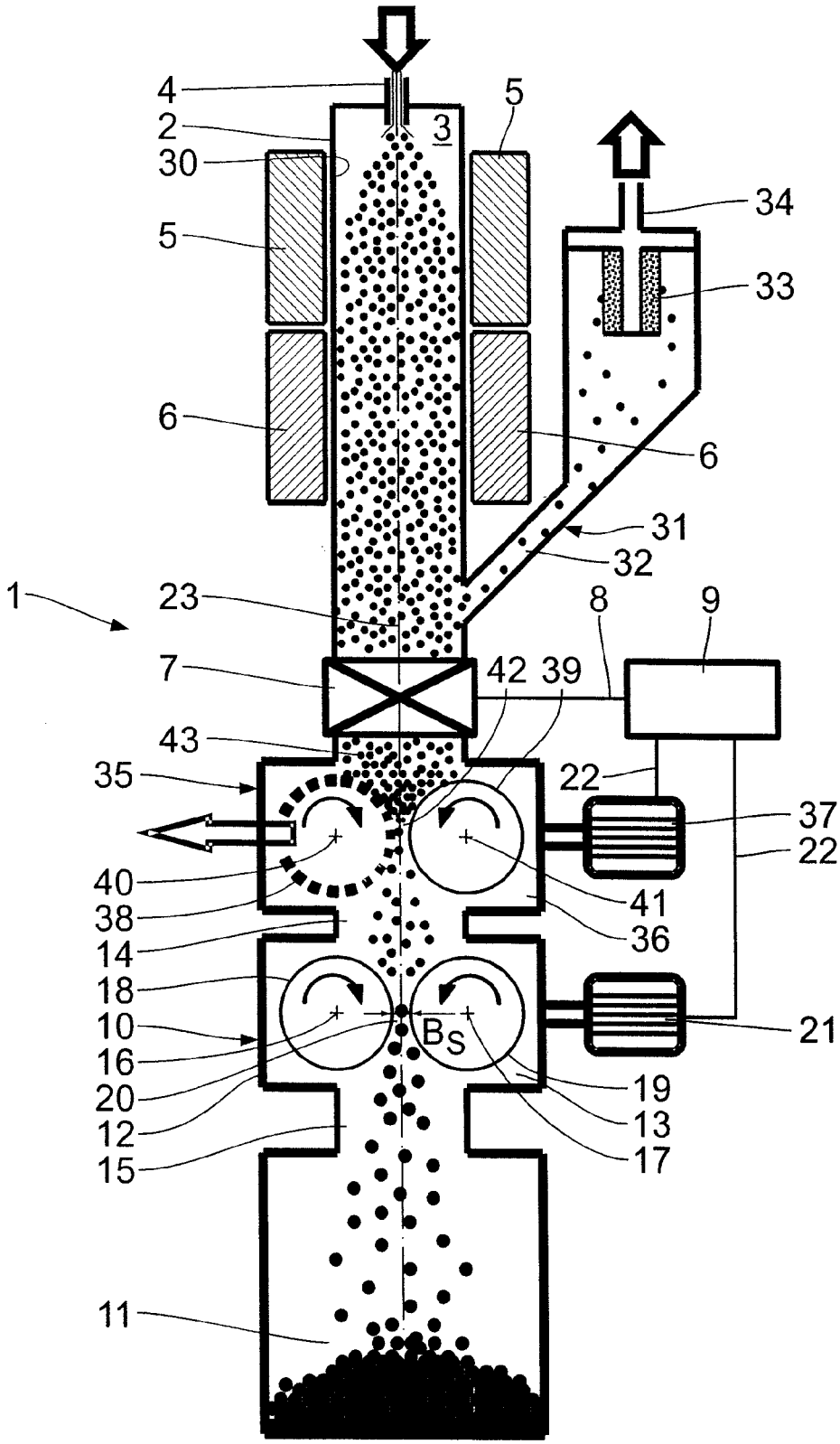
FIG. 1 shows a cross-section of a plant for producing silicon with a compacting device according to a first embodiment, FIG. 2 an enlarged view of a compacting roller of the compacting device according to FIG. 1 and FIG. 3 an enlarged view of a compacting roller according to a second embodiment.
Figure 2:
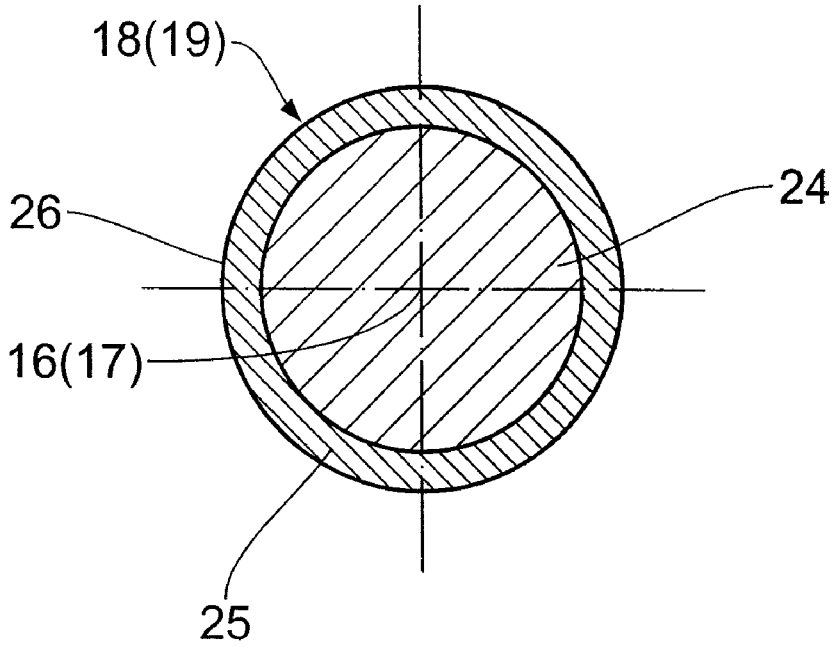

There will be described first of all below with reference to FIGS. 1 and 2 the layout of a plant 1 for producing silicon powder according to a first embodiment. The plant 1 comprises, starting from the top, a tube-shaped, vertically extending reactor 2 which encloses a cylindrical reaction chamber 3. At the upper end of the reactor 2 is arranged a gas feed line 4 which merges into the reaction chamber 3. The line 4 is so formed that a useful gas flow, for example of monosilane, can be introduced in the middle. The useful gas flow is surrounded by a circular flow of an auxiliary gas. Roughly the upper half of the reactor 2 is surrounded by a cylindrical heater 5 which surrounds the reactor 2 in such a way that the wall of the chamber 3 can be heated to temperatures of more than 800° C. The lower half of the reactor 2 is surrounded by a cylindrical cooling device 6 which directly abuts the reactor 2. Below the reactor 2, and connected thereto, is located a degassing device 31 and an electrically operated air lock 7 which is connected via a connecting line 8 to a control device 9. The degassing device 31 consists of a casing 32 extending diagonally upwards and connected to the chamber 3, said casing 32 being added onto the bottom end of the reactor 2. At the upper end of the casing 32 is attached a cylindrical sintered material filter 33 sealed at the bottom, through which surplus hydrogen can escape through an opening 34 made in the upper end of the casing 32. Below the air lock 7 is located a roller vent unit 35 of a known type and then a compacting device 10 the layout of which will be described in detail below. The compacting device 10 is connected to the reaction chamber 3 via the air lock 7. Below the device 10 is located a storage vessel 11 connected thereto.

The roller vent unit 35 comprises a cuboid casing 36 in which are arranged two vent rollers 38, 39 driven by a motor 37. The rollers 38, 39 are rotatable about associated axes of rotation 40, 41 extending parallel to one another. The rollers 38, 39 are driven in opposite directions, so that in the region of the gap 42 bounded by the rollers 38, 39 both move downwards. The roller 38 is hollow and possesses a porous jacket. On its jacket surface is fitted a gas-permeable plastics film. A vacuum exists within the roller 38. In this way the gas remaining in the silicon powder 43 is drawn off. The surface of the roller 39 is smooth. Both the rollers 38, 39 preferably possess a non-metallic surface.

The compacting device 10 comprises a casing 12 which surrounds a substantially cubic working chamber 13. The casing 12 comprises a feed opening 14 facing the air lock 7 and connected thereto, as well as a discharge opening 15 provided on the bottom edge of the casing 12 and connected to the vessel 11. In the casing 12 are located centrally between the openings 14 and 15 two compacting rollers 18, 19 rotatable about respective axes of rotation 16, 17, said compacting rollers 18, 19 being arranged adjacent to one another in such a way that a compacting gap 20 is formed between them. The axes of rotation 16 and 17 extend parallel to one another. The compacting gap 20 exhibits a width $B_S$. The compacting rollers 18, 19 are rotatable via a motor 21, which is connected to the control device 9 via a connecting line 22. The tube-shaped reactor 2 comprises a vertically extending central longitudinal axis 23, which runs through the centre of the gap 20. The rollers 18, 19 are driven in opposite directions, i.e. the roller 19 turns in a clockwise direction, the roller 19 in an anti-clockwise direction. As a result, the surfaces of the rollers 18, 19 move jointly downwards in the region of the gap 20.

The rollers 18, 19 exhibit a roller core 24 consisting of steel, which has the shape of a regular cylinder. On the roller core 24 is located a roller jacket 25 circular in cross-section, which peripherally surrounds the roller core 24 completely. The roller jacket 25 is formed of one piece and consists of a non-metal material, that is to say a non-metallic material. Glass, graphite or ceramic materials are in particular involved here. Ceramic is particularly preferred. The ceramic used consists in particular substantially of silicon nitride. The roller jacket 25 is fixed to the roller core 24 in axial and tangential direction, for example by bonding or groove and tongue joints. The roller jacket 25 has the shape of a regular cylinder. It is possible for the whole of roller 18 or 19 to be formed of a ceramic material. In this case the division between a roller core 24 of steel and a roller jacket 25 of ceramic does not apply. The embodiment according to FIG. 2 is more stable and more advantageous above all in terms of the application of torsional moments to the surface 26 of the jacket 25.

Figure 3:
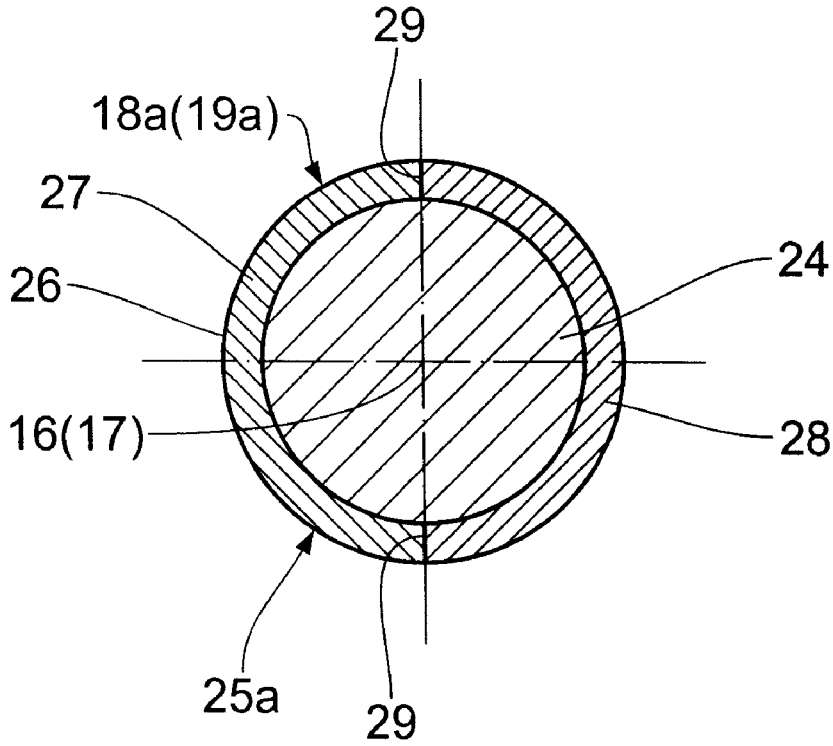

FIG. 3 shows a second embodiment. Identical parts receive the same reference symbols as in the embodiment according to FIG. 2. Parts differing in construction but identical in function receive the same reference symbols with an added a. The main difference compared with the embodiment according to FIG. 2 consists in the fact that the roller jacket 25*a* is not formed of one piece, but consists of two half shells 27 and 28 which enclose the roller core 24 completely and without interruption. In particular the gaps 29 between the half shells 27 and 28 are sealed completely and without interruption, so that material that gets onto the surface 26 does not come into contact with the roller core 24. After the ceramic fabrication the half shells 27, 28 were subjected to an exact machining. As part of the machining, the surface of the half shells 27, 28 was profiled. The surface of the half shells 27, 28 can also be so formed that the compacted silicon possesses the shape of rodlets, pads, almonds etc. Despite the high specific contact pressures occurring, the material combination of ceramic and metal withstood the machining. It is also possible to use part shells with a centre angle of <180° on the periphery. In particular, three part shells with a centre angle of 120° or four part shells with a centre angle of 90° can be provided on the periphery. Other subdivisions are also possible.

The process for producing silicon will first of all be described below by means of an example. A gaseous mixture of monosilane and hydrogen in the volume or molar ratio 1:3 was reacted in the reactor 2 with a wall temperature of the wall 30 of >800° C. and a production rate of 200 g of silicon per hour to silicon powder and hydrogen. The feeding took place in such a way that the monosilane was introduced centrally from above into the reaction chamber 3. The hydrogen surrounded the monosilane in the form of a circular current in order to prevent the silicon being deposited directly on the walls of the reaction chamber 3. After the degrading the silicon powder 43 was partially degassed by means of the degassing device 31 arranged on the air lock 7. The powder obtained possessed a bulk density of approx. 50 g/l. In the reaction chamber 3 an excess pressure of 200 mbar compared with the ambience was applied. In this way the degassing in the degassing device 31 took place automatically in the face of the ambient pressure. In the case of the silicon powder the hydrogen atmosphere in the powder was replaced with an inert gas, e.g. argon or nitrogen, in two steps by means of the roller vent unit 35 and the compacting device 10. The vented and pre-compressed product with a bulk density of approx. 200 g/dm$^3$ was compressed by means of the compacting device 10 to a bulk density of 450 g/dm$^3$. 6 kg of said compacted silicon powder were placed in an induction melting plant IS30 of the firm Leybold. The plant was then evacuated. An argon atmosphere with a pressure of between 1 and 100 mbar was generated. The silicon powder was heated to a melt temperature of 1415° C. Residue-free melting of the silicon powder then took place at 1450° C. in 30 minutes with a melting power of 70 kW. After this the silicon melt was poured off and controlled solidification of the silicon brought about. The solidified polycrystalline silicon block showed a homogeneous polycrystalline structure of the silicon, and no residues of silicon powder or silicon-containing slag.

The following applies in general to the process according to the invention: In general a silicon-containing gas can be degraded in the reactor. Examples of this are trichlorosilane or monosilane. Other silicon-containing gases can also be used. The silicon-containing gas is introduced centrally into the tube-shaped reactor 2 and is in so doing surrounded by a circular current of an auxiliary gas, in order that the silicon-containing gas is not deposited directly on the reactor walls. The auxiliary gas can in general be an inert gas. Hydrogen is particularly advantageous, since it is also formed during the degrading, for example, of monosilane. Noble gases such as argon can also be used, however, as well as other gases such as e.g. nitrogen or carbon dioxide. The mixture ratio, i.e. volume or molar ratio, of monosilane to hydrogen can lie between 1:0 and 1:100. The specific energy requirement per 1 kg of solid silicon for the process steps of thermal degradation and mechanical compacting was less than 20 kWh. The space-time yield per tube-shaped reactor 2 was more than 1 kg of silicon powder per hour. The wall temperature of the reactor 2 was more than 400° C., in particular more than 800° C. The compacting of the silicon powder can take place in one or two stages, with advantage in two stages. The contact pressures in the compacting device 10 were between 5 N/cm and 50 kN/cm.

It is of central importance that the compacting of the silicon powder in the device 10 takes place metal-free and that no metal contamination of the silicon powder therefore takes place. This is ensured by the fact that the silicon powder comes into contact exclusively with the ceramic roller jacket 25.

The high-purity powdery silicon produced by the method according to the invention possesses, despite its powdery normal state, good handling properties and is suitable for the production of pure silicon melts, from which silicon blocks or silicon crystals can be produced. It has been found that it is possible with the defined composition of the pyrolysis gas consisting of hydrogen and monosilane to produce silicon in powder form with high yields and very low energy consumption. The process is particularly distinguished by the fact that after the carrying out of the method the silicon powder can be handled, packaged and dispatched separately and thus be used with a time delay for the production of silicon blocks or silicon crystals. The silicon is distinguished by good melting characteristics and a high purity, despite a large surface region and an unfavourable, small volume/surface ratio compared with Prime Poly silicon.

The silicon powder produced by the thermal degrading possessed a bulk density of 10 to 100 g/dm$^3$. The silicon powder fully compacted by the compacting device 10 possessed a bulk density of 100 to 1500 g/dm$^3$, in particular of 200 to 1200 g/dm$^3$, in particular of 250 to 950 g/dm$^3$, in particular approx. 450 g/dm$^3$. The silicon powder contained overall not more than $10^{19}$ atoms of foreign elements per 1 cm$^3$ of silicon. The silicon powder consisted of crystalline particles with a primary particle size of 10 nm to 10,000 nm, preferably 50 nm to 500 nm, typically approx. 200 nm. The compacted silicon powder consisted of aggregates with an aggregate size of 500 nm to 100,000 nm, in particular 1000 to 10,000 nm, typically about 4000 nm. The compacted silicon pieces of silicon aggregates possessed a great size of 1 to 200 nm. They possessed an irregular form, it being possible for rodlets also to be involved. The silicon powder possessed a surface region of 1 to 50 m$^2$/g. The compacted silicon powder possessed overall not more than $10^{17}$ atoms of transition metals per 1 cm$^3$ of silicon. The silicon powder according to the invention has a brown colour, whereas silicon granules produced by traditional methods are grey. The compacted silicon powder can be used to produce polycrystalline silicon blocks for the photovoltaic industry or to produce silicon monocrystals. Silicon wafers can be produced from the silicon according to the invention. The metal content of the compacted silicon powder corresponded to that of the starting product. No impurities were found. As a result of the production process the silicon contained no silicon oxide compounds on the surface of the silicon particles that would have increased significantly the melting temperature of the silicon powder.

The invention claimed is:

1. A compacting device for the low-metal compaction of a silicon powder, the device comprising:

a casing at least surrounding a working chamber;

a feed arrangement arranged on the casing, said feed arrangement feeding a silicon powder, which is to be compacted, into the working chamber;

a first compacting roller rotatably arranged in the working chamber;

a second compacting roller rotatably arranged in the working chamber, said first compacting roller comprising a first roller jacket, said second compacting roller comprising a second roller jacket, said first compacting roller and said second compacting roller forming a compacting gap for compacting the silicon powder therein, said first roller jacket and said second roller jacket consisting of ceramic, said first compacting roller having a first core, said first roller jacket surrounding said first core, said second compacting roller having a second core, said second roller jacket surrounding said second core, said first core and said second core being composed of metal, said first roller jacket being bonded to said first core, said second roller jacket being bonded to said second core.

2. Compacting device according to claim 1, wherein said first compacting roller is rotatably mounted about a first axis of rotation and said second compacting roller is rotatably mounted about a second axis of rotation, said first axis of rotation extending in parallel to said second axis of rotation.

3. Compacting device according to claim 1, wherein each roller jacket has substantially the shape of an annular cylinder.

4. Compacting device according to claim 1, wherein each roller jacket is formed in one piece.

5. Compacting device according to claim 1, wherein each roller jacket is formed from two half shells.

6. A compacting device for low-metal compaction of a silicon powder, the device comprising:

a casing defining at least a portion of a working chamber;

a feeding means arranged on said casing for feeding a silicon powder into said working chamber;

a first compacting roller rotatably arranged in said working chamber, said first compacting roller comprising a first compacting roller jacket and a first compacting roller core, said first compacting roller jacket engaging said first compacting roller core such that said first compacting roller jacket surrounds said first compacting roller core, said first compacting roller jacket consisting of ceramic material, said first compacting roller core being composed of metal;

a second compacting roller arranged in the working chamber, said second compacting roller comprising a second compacting roller jacket and a second compacting roller core, said second compacting roller jacket engaging said second compacting roller core such that said second compacting roller jacket surrounds said second compacting roller core, said second compacting roller jacket consisting of ceramic material, said first compacting roller and said second compacting roller defining a compacting gap, said compacting gap receiving said silicon powder such that said first compacting roller and said second compacting roller compact said silicon powder within said compacting gap, said first compacting roller and said second compacting roller compacting the silicon powder at a specific contact pressure in a range from 5 N/cm to 50 kN/cm.

7. A compacting device according to claim 6, wherein said first compacting roller is rotatably mounted about a first axis of rotation and said second compacting roller is rotatably mounted about a second axis of rotation, said first axis of rotation being parallel to said second axis of rotation.

8. A compacting device according to claim 6, wherein said first compacting roller jacket and said second compacting roller jacket have the shape of an annular cylinder.

9. A compacting device according to claim 6, wherein said first compacting roller jacket and said second compacting roller jacket are formed in one piece.

10. A compacting device according to claim 6, wherein said first compacting roller jacket comprises two first roller half shells, said second compacting roller jacket comprising two second roller half shells.

11. A compacting device for low-metal compacting of a silicon powder, the device comprising:

a casing defining at least a portion of a working chamber;

a feeding means arranged on said casing for feeding a silicon powder to the working chamber;

a first compacting roller rotatably arranged in the working chamber, said first compacting roller comprising a first roller jacket and a first core, said first roller jacket contacting said first core such that said first roller jacket surrounds said first core, said first roller jacket consisting of ceramic, said first core being composed of metal;

a second compacting roller arranged in the working chamber, said second compacting roller comprising a second roller jacket and a second core, said second roller jacket contacting said second core such that said second roller jacket surrounds said second core, said second roller jacket consisting of ceramic, said second core being composed of metal, said first compacting roller and said second compacting roller defining a compacting gap, said first compacting roller and said second compacting roller compacting the silicon powder in said compacting gap, said first roller jacket having a first roller profiled surface, said second roller jacket having a second roller profiled surface.

12. A compacting device according to claim 11, wherein said first compacting roller is rotatably mounted about a first axis of rotation and said second compacting roller is rotatably mounted about a second axis of rotation, said first axis of rotation being parallel to said second axis of rotation.

13. A compacting device according to claim 11, wherein said first roller jacket and said second roller jacket have a shape of a substantially annular cylinder.

14. A compacting device according to claim 11, wherein said first roller jacket is formed in one piece, said second roller jacket being formed in one piece.

15. A compacting device according to claim 11, wherein said first roller jacket comprise two first jacket half shells, said second roller jacket comprising two second jacket half shells.

* * * * *